United States Patent [19]

Masumoto et al.

[11] Patent Number: 4,842,657

[45] Date of Patent: Jun. 27, 1989

[54] AMORPHOUS ALLOYS CONTAINING IRON GROUP ELEMENTS AND ZIRCONIUM AND PARTICLES MADE OF SAID ALLOYS

[75] Inventors: Tsuyoshi Masumoto, Sendai; Kiyoyuki Esashi, Higashiosaka; Masateru Nose, Itami, all of Japan

[73] Assignee: Shin-Gijutsu Kaihatsu Jigyodan, Tokyo, Japan

[21] Appl. No.: 220,046

[22] PCT Filed: Mar. 19, 1980

[86] PCT No.: PCT/JP80/00046

§ 371 Date: Dec. 5, 1980

§ 102(e) Date: Dec. 5, 1980

[87] PCT Pub. No.: WO80/02159

PCT Pub. Date: Oct. 16, 1980

[30] Foreign Application Priority Data

Apr. 11, 1979 [JP] Japan ..... 54-43838

[51] Int. Cl.[4] ..... C22C 19/00

[52] U.S. Cl. ..... 148/403; 148/304; 420/70; 420/72; 420/83; 420/89; 420/95; 420/103; 420/104; 420/117; 420/119; 420/120; 420/121; 420/125; 420/127; 420/435; 420/436; 420/442; 420/581; 420/583

[58] Field of Search ..... 75/134 F, 170, 171, 75/123 H, 125, 126 F, 128 Z, 124 B, 124 C, 124 E, 124 F; 148/403, 304; 420/435, 436, 442, 581, 583, 72, 70, 83, 89, 95, 103, 104, 117, 119, 120, 121, 125, 127

[56] References Cited

U.S. PATENT DOCUMENTS

| | | | |
|---|---|---|---|
| 3,986,867 | 10/1976 | Masumoto et al. | 75/126 A |
| 4,056,411 | 11/1977 | Chen et al. | 148/121 |
| 4,116,682 | 9/1978 | Polk et al. | 75/123 H |
| 4,225,339 | 9/1980 | Inomata et al. | 75/122 |
| 4,306,908 | 12/1981 | Takayama et al. | 148/403 |
| 4,437,912 | 3/1984 | Sakakima et al. | 148/403 |

FOREIGN PATENT DOCUMENTS

| | | | |
|---|---|---|---|
| 51-4017 | 1/1976 | Japan | 75/126 H |
| 51-20011 | 2/1976 | Japan . | |
| 51-73923 | 6/1976 | Japan . | |
| 53-47321 | 4/1978 | Japan . | |

OTHER PUBLICATIONS

Buschow et al., "Thermal Stability and Electronic Properties of Amorphous Zr-Co and Zr-Ni-Alloys", Physical Review B, vol. 19, No. 8, Apr. 15, 1979, pp. 3843-3849.

Heiman et al., "Magnetic Properties of Amorphous Alloys of Fe with La, Lu, Y and Zr", Physical Review B, vol. 19, No. 3, Feb. 1, 1979, pp. 1623-1632.

Heiman et al., "Concentration Dependence of the Co Moment in Amorphous Alloys of Co with Y, La and Zr", Physical Review B, vol. 17, No. 5, Mar. 1979, pp. 2215-2220.

Polesya et al., "Formation of Amorphous Phases and Metastable Solid Solutions in Binary Ti and Zr Alloys With Fe, Ni and Cu", IZV. AKAD. NAVK. SSR, Metal, 1973 #6, pp. 173-178.

Varich et al., "Metastable Phases in Binary Nickel Alloys Crystallized During Very Rapid Cooling", Dz-Metal Metalloved, 33, No. 2, pp. 335-338, 1972.

*Primary Examiner*—John P. Sheehan

*Attorney, Agent, or Firm*—Parkhurst, Oliff & Berridge

[57] ABSTRACT

Amorphous alloys containing zirconium as an amorphus forming metal and having the formula $X_\alpha Z_\gamma$ wherein X is at least one of Fe, Co and Ni, $\alpha$ is 80 to 92 atomic %, Z is zirconium, $\gamma$ is 8 to 20 atomic % and the sum of $\alpha$ and $\gamma$ is 100 atomic %, cause very little variation of properties during aging and embrittlement because they contain no metalloid as the amorphous forming element, and they further have excellent strength, hardness, corrosion resistance and heat resistance and maintain superior magnetic properties which are characteristic of iron group elements.

19 Claims, 3 Drawing Sheets

AMORPHOUS ALLOYS CONTAINING IRON GROUP ELEMENTS AND ZIRCONIUM AND PARTICLES MADE OF SAID ALLOYS

TECHNICAL FIELD

The present invention relates to amorphous alloys and articles made of said alloys and particularly to amorphous alloys containing iron group elements and zirconium and articles made of said alloys.

BACKGROUND ART

Solid metals or alloys generally possess crystalline structures but if a molten metal is quenched rapidly (the cooling rate is approximately $10^{4°}$–$10^{6°}$ C./sec), a solid having a non-crystalline structure, which is similar to a liquid structure and has no periodic atomic arrangement, is obtained. Such metals or alloys are referred to as amorphous metals or alloys. In general, metals of this type are alloys consisting of two or more elements and can be classified into two groups, generally referred to as metal-metalloid alloys and inter-metal (metal-metal) alloys.

As the former embodiment, Fi-Ni-P-B (Japanese Patent Laid-Open Application No. 910/74), Fe-Co-Si-B (Japanese Patent Laid-Open Application No. 73,920/76) and the like have been known.

As the latter embodiment, only U-Cr-V (Japanese Patent Laid-Open Application No. 65,012/76) has been recently reported except for $Zr_{60}Cu_{40}$, $Zr_{78}Co_{22}$ and the like which were reported previously. Particularly, as amorphous alloys of a combination of iron elements and group IVB, VB Group elements which contains less than 50 atomic % of Group IVB or VB elements, only $Nb_{100-x}Ni_x$ (x: 33–78) and $Zr_{100-x}Ni_x$ (x: 40–60) have been known.

Already known amorphous metals of combinations of iron group elements and metalloids, for example, Fe-P-C or Fe-Ni-P-B have excellent properties in view of strength, hardness, magnetic properties and the like. However, the structure of these alloys is unstable, so that the properties vary considerably during aging and this is a great practical drawback. In addition, it has been known concerning heat resistance that embrittlement occurs even at a lower temperature than the crystallization temperature as well as at a higher temperature than the crystallization temperature. This phenomenon is presumably based on the fact that the atomic radius of the metalloid element contributing to the amorphous formation is smaller than that of the iron group elements and diffusion of the metalloid atom takes place easily in these alloys.

On the other hand, in metal-metal amorphous alloys, it has been known that the content of elements having a small atomic radius is not large, so that embrittlement at a lower temperature than the crystallization temperature seldom occurs. Even at a higher temperature than the crystallization temperature, the extent of embrittlement of these amorphous alloys is smaller than that of metal-metalloid amorphous alloys.

However, previously reported metal-metal amorphous alloys contain a large amount of Group IVB and VB elements (Ti, Zr, V, Nb, Ta), so that the cost of the raw materials is very high, the melting point of those alloys is high and the molten metal is easily oxidized, therefore the production of these amorphous alloys is very difficult. Thus there is a disadvantage with difficulties in production of ribbon, sheet and wire in good shapes which can be utilized for practical usages in industries. Furthermore, a problem exists that the strong ferromagnetic property which is characteristic to iron group elements is lost.

An object of the present invention is to provide metal-metal amorphous alloys in which the above described drawbacks and problems of already known metal-metalloid amorphous alloys or metal-metal amorphous alloys are obviated and improved.

DISCLOSURE OF INVENTION

The present invention can accomplish the above described object by providing amorphous alloys containing iron group elements and zirconium as described hereinafter. The invention is particularly directed to the following two types of amorphous alloys:

(1) Amorphous alloys containing iron group elements and zirconium and having the composition defined by the following formula $$X_\alpha Z_\gamma$$

wherein $X_\alpha$ shows that at least one element selected from the group consisting of Fe, Co and Ni is contained in an amount of $\alpha$ atomic %, $Z_\gamma$ shows the Zr is contained in an amount of $\gamma$ atomic %, the sum of $\alpha$ and $\gamma$ is 100 and $\alpha$ is 80 to 92 and $\gamma$ is 8 to 20.

(2) Amorphous alloys containing iron group elements and zirconium and having the composition defined by the following formula $$X_{\alpha'}Y_{\beta'}Z_{\gamma'}$$

wherein $X_{\alpha'}$ shows that at least one element selected from the group consisting of Fe, Co and Ni is contained in an amount of $\alpha'$ atomic %, $Y_{\beta'}$ shows that at least one element selected from the group consisting of Cr, Mo and W belonging to Group VIB, Ti, V, Nb and Ta belonging to Group IVB or VB, Mn and Cu of transition metals, Be, B, Al, Si, In, C, Ge, Sn, N, P, As and Sb belonging to IIA, IIIA, IVA or VA and lanthanum group elements is contained in an amount of $\beta'$ atomic %, and $Z_{\gamma'}$ shows that Zr is contained in an amount of $\gamma'$ atomic %, the sum of $\alpha'$, $\beta'$ and $\gamma'$ is 100 and each value of $\alpha'$, $\beta'$ and $\gamma'$ is shown in the following paragraphs (A), (B), (C), (D), (E) and (F):

(A) when Y is at least one element selected from the group consisting of Cr, Mo and W, $\alpha'$ is 40 to 92, $\beta'$ is not more than 40 and $\gamma'$ is 5 to 20, provided that the sum of $\beta'$ and $\gamma'$ is not less than 8, (B) when Y is at least one element selected from the group consisting of Ti, V, Nb, Ta, Cu and Mn, $\alpha'$ is 45 to 92, $\beta'$ is not more than 35, $\gamma'$ is 5 to 20, provided that the sum of $\beta'$ and $\gamma'$ is not less than 8, (C) when Y is at least one element selected from the group consisting of Be, B, Al and Si, $\alpha'$ is 67 to 92, $\beta'$ is less than 13 and $\gamma'$ is 3 to 20, provided that the sum of $\beta'$ is not less than 8, (D) when Y is at least one element selected from the group consisting of C, N, P, Ge, In, Sn, As and Sb, $\alpha'$ is 70 to 92, $\beta'$ is not more than 10 and $\gamma'$ is 5 to 20, provided that the sum of $\beta'$ and $\gamma'$ is not less than 8, (E) when Y is at least one element selected from lanthanum group elements, $\alpha'$ is 70 to 92, $\beta'$ is not more than 10 and $\gamma'$ is 8 20, provided that the sum of $\beta'$ and $\gamma'$ is not less than 8, and (F) when elements of at least two groups selected from the above described groups (A), (B), (C), (D) and (E) are combined, $\beta'$ is within the range of $\beta'$ value in each of the groups (A), (B), (C), (D) and (E) and the total value of $\beta'$ is not more than 40, $\alpha'$ is 40 92, $\gamma'$ is 5 to 20 and the sum of $\beta'$ and $\gamma'$ is not less than 8, provided that when at least one element is selected from each of the groups (C) and (D), the sum of these elements is less than 13 atomic %.

The inventors have found novel amorphous alloys, which contain a small amount of 8 to 20 atomic % of Zr as an element which contributes to formation of amorphous alloys of iron group elements of Fe, Co and Ni yet scarcely causes variation of properties during aging or embrittlement, have excellent properties of strength, hardness, corrosion resistance and heat resistance and do not deteriorate magnetic properties which are characteristic of iron group elements, and accomplish the present invention.

BEST MODE OF CARRYING OUT THE INVENTION

Figure 1:
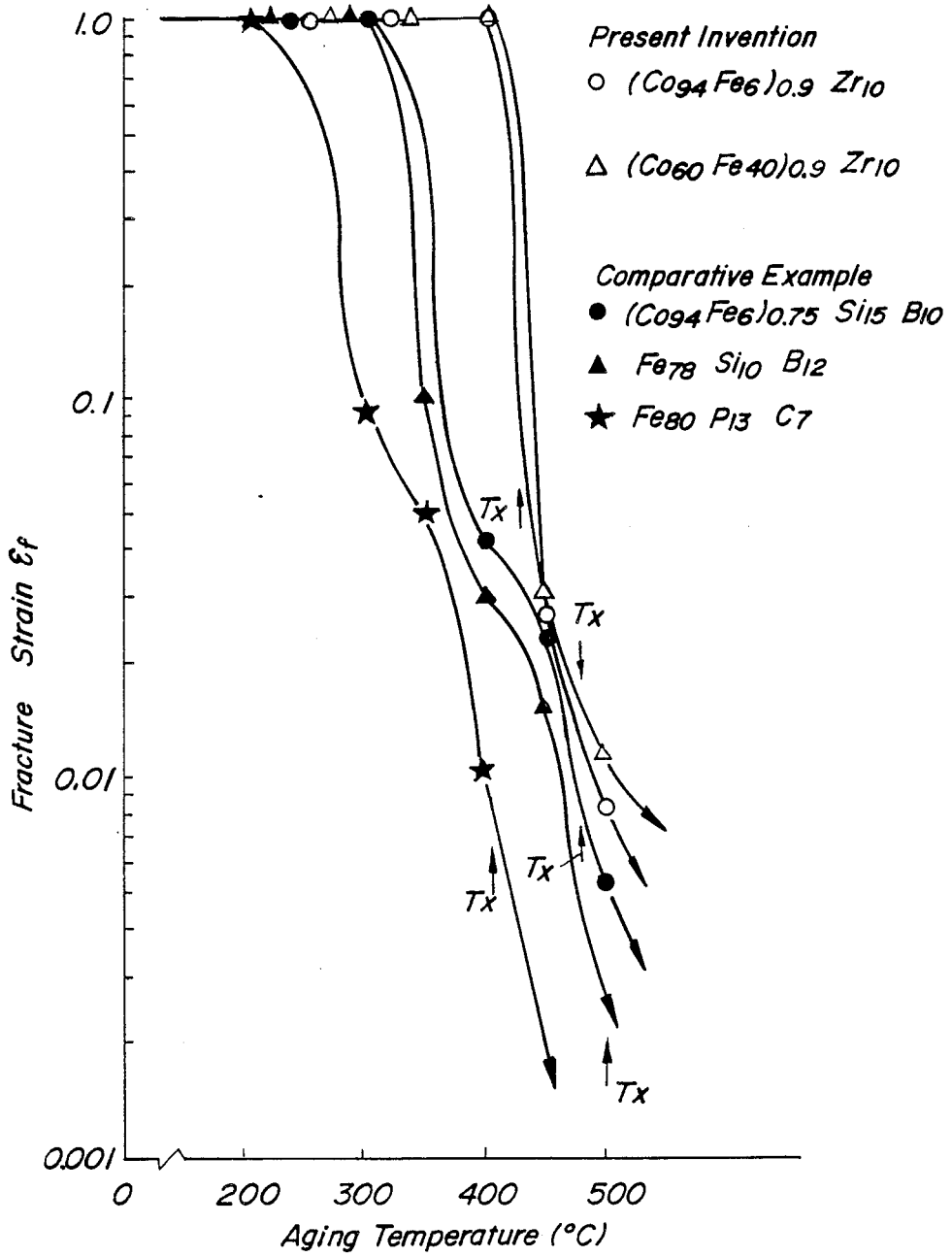
FIG. 1 is a graph showing the relation between aging temperature and fracture strain $\epsilon_f$ of amorphous alloys of the present invention and well known metal-metalloid amorphous alloys.

A major part of the amorphous alloys of the present invention have the practically very useful characteristics that these alloys can maintain ductility and toughness even at temperatures close to the crystallization temperature as shown in FIG. 1 and that even at a higher temperature than the crystallization temperature, the extent of embrittlement is lower than that of amorphous alloys containing a large amount of metalloid.

In general, the embrittlement of amorphous alloys has been estimated by the process wherein an amorphous alloy ribbon is put between two parallel plates and the distance L between the parallel plates is measured and a value L when the sample ribbon is fractured by bending is determined and the fracture strain is defined by the following formula $$\epsilon_f = \frac{t}{L - t}$$

wherein t is the thickness of the ribbon. The inventors have measured the fracture strain $\epsilon_f$ with respect to the samples maintained at each temperature for 100 minutes for comparison of the amorphous alloys of the present invention with the metal-metalloid amorphous alloys following to this method. The above described FIG. 1 shows that even though the amorphous alloys of the present invention have a lower crystallization temperature Tx than a $(Co_{94}Fe_6)_{0.75}Si_{15}B_{10}$ alloy which is relatively strong against embrittlement among the metal-metalloid amorphous alloys, the temperature at which embrittlement starts is 100° C. higher and this shows that the embrittlement is hardly caused. Such properties are very advantageous, because the amorphous alloys of the present invention are not embrittled even by the inevitable raised temperature in the heat treatment or production step when the alloys are used for tools, such as blades, saws, etc., for hard wires, such as tire cords, wire ropes, etc., and for composite materials with vinyl, rubber, etc.

In general, amorphous alloys are obtained by rapidly quenching molten alloys, and a variety of quenching processes have been proposed. For example, the process wherein a molten metal is continuously ejected on an outer circumferential surface of a disc (FIG. 2(*a*)) rotating at a high speed or between two rolls (FIG. 2(*b*)) reversely rotating with each other at a high speed to rapidly cool the molten metal on the surface of the rotary disc or both rolls at a cooling rate of about $10^{5°}$ to $10^{6°}$ C./sec and to solidify the molten metal has been publicly known. Furthermore, the method and apparatus for directly producing a wide thin strip from a molten metal, which have been developed by one of the inventors (Japanese Patent Laid-Open Application No. 125,228/78, No. 125,229/78) may be used.

The amorphous alloys of the present invention can be similarly obtained by rapidly quenching the molten metal, and by the above described various processes wireshaped or sheet-shaped amorphous alloys of the present invention can be produced. Furthermore, amorphous alloy powders from about several μm to 10 μm can be produced by blowing the molten metal to a cooling copper plate using a high pressure gas (nitrogen, argon gas and the like) to rapidly cool the molten metal in fine powder form, for example, by an atomizing process. Accordingly, powders, wires or plates composed of amorphous alloys of iron group elements of the present invention, which contain zirconium, can be produced on a commercial scale.

In the alloys of the present invention, even if a small amount, that is an extent which is admixed from starting materials, of impurities, for example, Hf, O, S, etc., is contained, the object of the present invention can be accomplished.

Particularly, Hf is generally contained in an amount of 1 to 3% in raw ore of Zr to be used as one component of the alloys of the present invention, and since Hf is very similar to Zr in physical and chemical properties, it is very difficult to separate both the components and refine Zr by a usual refining process. In the present invention, even if about 2% of Hf is contained, the object of the present invention can be attained.

The composition of the first and second aspects of the present invention is shown in the following Table 1, and the reason for limiting the component composition is explained hereinafter.

TABLE 1

| Alloys of first invention | | $X_\alpha Z_\gamma$ ($\alpha + \gamma = 100$) $\alpha$ 80–92 | | $\gamma$ 8–20 | |
|---|---|---|---|---|---|
| | | $X_{\alpha'}Y_{\beta'}Z_{\gamma'}$ ($\alpha' + \beta' + \gamma' = 100$) $\alpha'$ | $\beta'$ | $\gamma'$ | $\beta' + \gamma'$ |
| Alloys of the second invention | (A) | 40–92 | not more than 40 | 5–20 | not less than 8 |
| | (B) | 45–92 | not more than 35 | 5–20 | not less than 8 |
| | (C) | 67–92 | less than 13 | 3–20 | not less than 8 |
| | (D) | 70–92 | not more than 10 | 5–20 | not less than 8 |
| | (E) | 70–92 | not more than 10 | 8–20 | not less than 8 |
| | (F) | 40–92 | *not more | 5–20 | not less |

TABLE 1-continued

| | $X_\alpha Z_\gamma$ ($\alpha + \gamma = 100$) | | | |
|---|---|---|---|---|
| | $\alpha$ | | $\gamma$ | |
| Alloys of first invention | 80–92 | | 8–20 | |
| | $X_{\alpha'}Y_{\beta'}Z_{\gamma'}$ ($\alpha' + \beta' + \gamma' = 100$) | | | |
| | $\alpha'$ | $\beta'$ | $\gamma'$ | $\beta' + \gamma'$ |
| | | than 40 | than 8 | |

Note
(1) $\alpha$, $\gamma$, $\alpha'$, $\beta'$, $\gamma'$ show atomic %.
(2) *$\beta'$ in (F) is not more than 40 but when at least one element is selected from each of the groups (C) and (D), the sum of these elements is less than 13.

In the alloys of the first aspect of the present invention, Zr acts as an amorphous forming element for iron group elements but in the alloys of the first aspect of the present invention wherein only iron group elements and Zr are combined, at least 8 atomic % of Zr is necessary for amorphous formation. When Zr is less than 8 atomic %, even if the molten metal is rapidly quenched and solidified, for example in the composition of $Co_{95}Zr_5$ or $Fe_{94}Zr_6$, a complete crystalline state is formed and in the composition of $Co_{93}Zr_7$, the ratio of the amorphous structure is about 50% in the whole structure.

In the alloys containing more than 20 atomic % of Zr, the melting point is higher than 2,000° C. and production becomes difficult, so that the amount of Zr added must be from 8 to 20 atomic %.

An explanation will now be made with respect to the alloys of the second aspect of the present invention.

Figure 3:
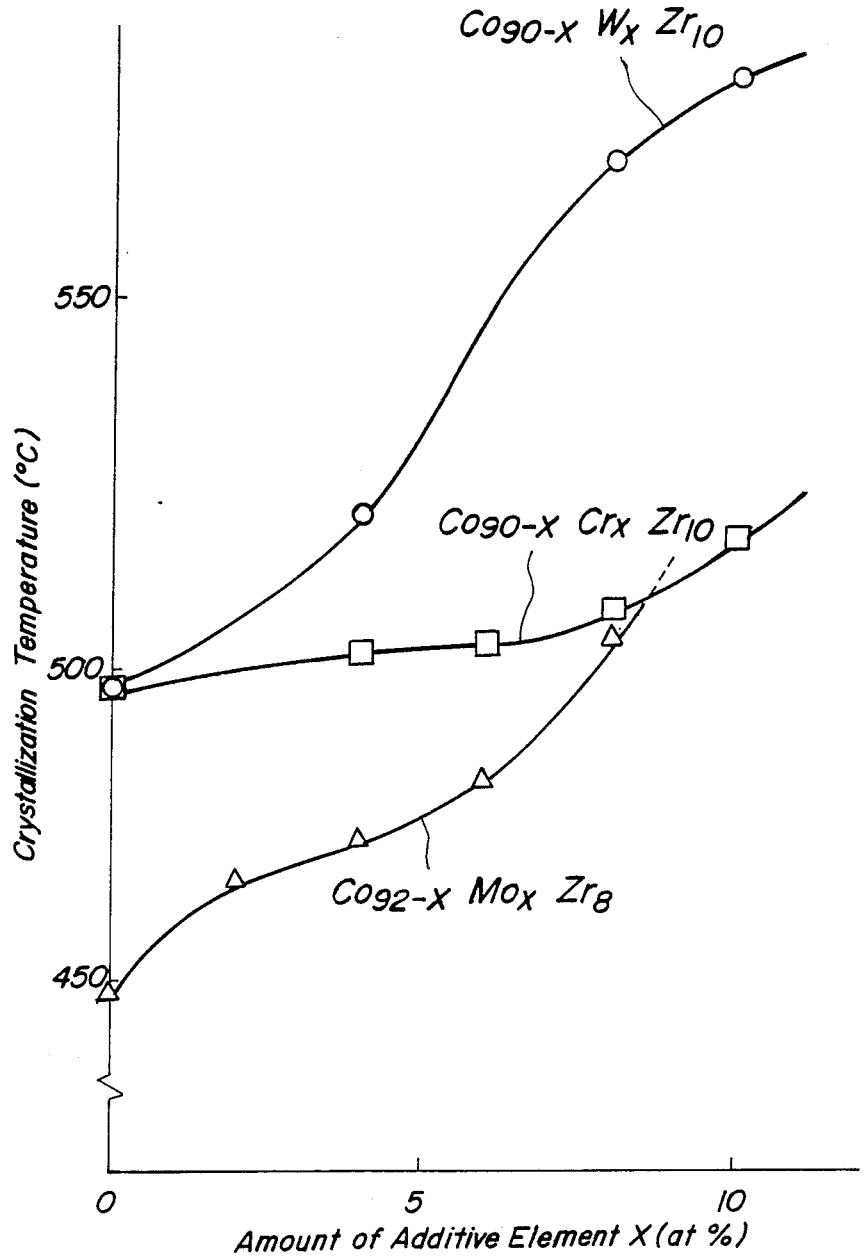
FIG. 3 is a graph showing the relation between an amount of Group VA elements added and the crystallization temperature.

(A) When Cr, Mo or W belonging to Group VIB is added as a third element, the crystallization temperature is raised as shown in FIG. 3 and thermal stability is increased. Particularly, this effect is noticeably high in W.

Cr and Mo improve corrosion resistance and increase strength, but when at least one element of Cr, Mo and W is added in the total amount of more than 40 atomic %, embrittlement occurs and the production of alloys becomes difficult, so that the upper limit is 40 atomic %.

By the synergistic effect of Zr and the above described Group VIB elements, even if the amount of Zr is less than 8 atomic % of the lower limit of Zr of the alloys in the first aspect of the present invention, the amorphous formation of iron group elements can be attained. However, when the amount of Zr is less than 5 atomic % or more than 20 atomic %, the amorphous formation cannot be attained, so that Zr must be 5 to 20 atomic %. Furthermore, when the sum of the above described Group VIB elements and Zr is less than 8 atomic %, the amorphous formation is difficult, so that said sum must not be less than 8 atomic %.

In alloys having the composition shown by the formula $(Fe_{1-x}Co_x)$-Y-Zr, when x is more than 0.5, that is in the composition wherein Co is alone or the number of Co atoms is larger than the number of Fe atoms, Mo has a large effect for reducing the amount of Zr necessary for the amorphous formation, and when x is less than 0.5, that is, in the composition wherein Fe is alone or the number of Fe atoms is larger than the number of Co atoms, Cr has a large effect for reducing the amount of Zr necessary for formation of the amorphous alloys.

Cr has a particularly large effect for improving the magnetic property, but in any case when the amount of Cr, Mo and W exceeds 20 atomic %, the strong ferromagnetic property is substantially lost or the magnetic induction is considerably reduced, so that for improvement of the magnetic properties, not more than 20 atomic % is preferable.

(B) Ti, V, Nb, Ta, Cu and Mn are added in order to make the production of the alloys easier, increase the strength, and improve the thermal stability and the magnetic properties for magnetic materials. In particular, among Ti, V, Nb, Ta, Cu and Mn, V has a noticeable effect for raising the crystallization temperature and making the production of the alloys easy, Ti, Nb and Ta have a noticeable effect for raising the crystallization temperature and improving the thermal stability. Cu and Mn have the effect for making the production of the alloys easy, and Cu is effective for improving corrosion resistance. However the addition of more than 35 atomic % of any of these elements makes production of the alloys difficult, so that the upper limit must be 35 atomic %. Concerning each element of V, Nb and Ta belonging to Group VB, the addition of more than 20 atomic % increases the embrittlement of the amorphous alloys, so that said amount is preferred to be not more than 20 atomic %.

Zr can form amorphous alloys of iron group elements by a synergistic effect with the above described elements, even if the amount of Zr is less than 8 atomic % of the lower limit of Zr in the alloys of the first aspect of the present invention. However, if said amount is less than 5 atomic % or more than 20 atomic %, amorphous formation is infeasible, so that the amount of Zr must be 5 to 20 atomic %. Furthermore, when the sum of Zr and at least one of V, Nb, Ta, Cu, Mn, and Ti is less than 8 atomic %, amorphous formation becomes difficult, so that said sum must be not less than 8 atomic %.

(C) At least one element of Be, B, Al and Si belonging to Group IIA, IIIA or IVA aids the amorphous formation and not only makes production of the alloys easy but also improves magnetic properties and corrosion resistance.

However, when more than 13 atomic % is added, not only is magnetic induction lowered but the thermal stability which is one great characteristic of the amorphous alloys of the present invention is also deteriorated. Thus an amount of less than 13 atomic %, preferably less than 10 atomic %, is preferred. Furthermore, Zr can form the amorphous alloys of iron group elements by the synergistic effect with Be, B, Al or Si, even if the amount is less than 8 atomic %, the lower limit of Zr in the alloys of the first aspect of the present invention. However, if the amount is less than 3 atomic % or more than 20 atomic %, the amorphous formation is infeasible, so that Zr must be present in an amount of 3 to 20 atomic %. When the sum of Zr and at least one of Be, B, Al and Si is less than 8 atomic %, the amorphous formation becomes difficult, so that the sum must be not less than 8 atomic %.

(D) At least one element of C, N, P, Ge, In, Sn, As and Sb belonging to Group IIIA, IVA or VA aids the formation of the amorphous alloys and makes the production of the amorphous alloys easy. Particularly P improves the corrosion resistance in coexistence with Cr, but when the amount exceeds 10 atomic %, the alloys are embrittled, so that said amount must be not more than 10 atomic %. Furthermore, Zr can form the amorphous alloys of iron group elements by the synergistic effect with C, N, P, Ge, In, Sn, As or Sb, even when the amount of Zr is less than 8 atomic % the lower limit of Zr in the alloys of the first aspect of the present invention. However, when Zr is less than 5 atomic % or more than 20 atomic %, the amorphous formation is impossible, so that Zr must be 5 to 20 atomic %. When the sum of the above described elements and Zr is less than 8 atomic %, the amorphous formation becomes difficult, so that said sum must be not less than 8 atomic %.

(E) The addition of lanthanum group elements facilitates the production of the amorphous alloys but the addition of more than 10 atomic % of lanthanum group elements considerably embrittles the alloys, so that the amount of addition must be not more than 10 atomic %. When Zr is less than 8 atomic % or more than 20 atomic %, the amorphyous formation is impossible, so that Zr must be 8 to 20 atomic %. When the sum of the above described lanthanum group elements and Zr is less than 8 atomic %, the amorphous formation becomes difficult, so that said sum must be not less than 8 atomic %.

(F) When the total amount of the third element group as mentioned in the above groups (A)-(E) exceeds 40 atomic %, embrittlement occurs and the production becomes difficult, so that said amount must be not more than 40 atomic %. When in this case, the sum of the elements selected from each of the group consisting of Be, B, Al and Si and the group consisting of C, N, P, In, Sn, As and Sb exceeds 13 atomic %, the thermal stability is deteriorated or the alloys are embrittled, so that the sum must be less than 13 atomic %.

Zr can form amorphous alloys of iron group elements by a synergistic effect with the third elements mentioned in the above described groups (A)-(E), even if the amount is less than 8 atomic % or the lower limit of Zr in the first aspect of the present invention. However, when said amount is less than 5 atomic % or more than 20 atomic %, amorphous formation is impossible, so that Zr must be 5 to 20 atomic %. Furthermore, when the sum of the above described elements and Zr is less than 8 atomic %, amorphous formation becomes difficult, so that the above described sum must be not less than 8 atomic %.

Physical properties, magnetic properties and corrosion resistance of the amorphous alloys of the present invention are shown in the following Examples.

EXAMPLE 1

Figure 2A:
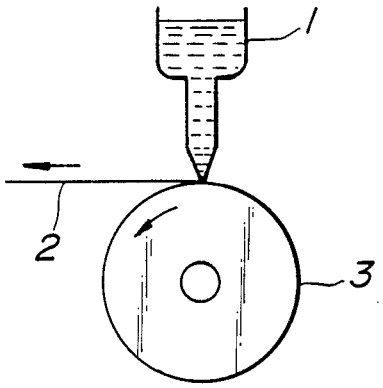
FIGS. 2(*a*) and (*b*) are schematic views of apparatuses for producing amorphous alloys.
Figure 2B:
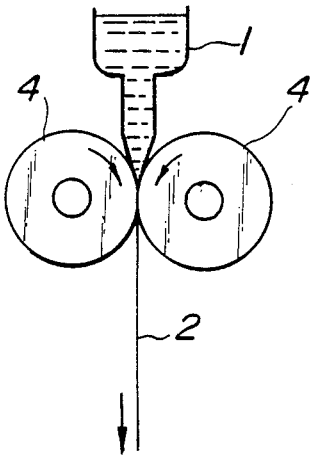

By using an apparatus as shown in FIG. 2*a*, various amorphous alloy ribbons having a width of 2 mm and a thickness of 25 μm according to the present invention were produced. The following Table 2 shows the component composition of the alloys of the present invention and the crystallization temperature and hardness of these alloys. The alloys of the present invention have a crystallization temperature higher than about 410° C. and particularly said temperature of the alloys consisting of multi-elements reaches about 600° C. and the Vickers hardness is more than 500 and the alloys are very hard.

TABLE 2(a)

| Alloys | Crystallization temperature Tx °C. | Hardness Hv DPN |
|---|---|---|
| $Fe_{92}Zr_8$ | 441 | — |
| $Fe_{90}Zr_{10}$ | 502 | 572 |
| $Fe_{80}Zr_{20}$ | 462 | 627 |
| $Co_{92}Zr_8$ | 448 | — |
| $Co_{91}Zr_9$ | 510 | 530 |
| $Co_{85}Zr_{15}$ | 464 | — |
| $Co_{80}Zr_{20}$ | 450 | — |
| $Ni_{92}Zr_8$ | 412 | 502 |
| $Ni_{89}Zr_{11}$ | 438 | 519 |
| $Ni_{80}Zr_{20}$ | 416 | 560 |
| $Fe_{54.6}Co_{36.4}Zr_9$ | 462 | — |
| $Fe_{36.4}Co_{54.6}Zr_9$ | 472 | 525 |

TABLE 2(a)-continued

| Alloys | Crystallization temperature Tx °C. | Hardness Hv DPN |
|---|---|---|
| $Fe_{5.46}Co_{85.54}Zr_9$ | 490 | 542 |
| $Fe_{54.6}Co_{27.3}Ni_{9.1}Zr_9$ | 440 | — |
| $Fe_{9.1}Co_{72.8}Ni_{9.1}Zr_9$ | 455 | 560 |
| $Fe_{80}Cr_{10}Zr_{10}$ | | 707 |
| $Fe_{67}Cr_{22}Zr_{11}$ | 621 | — |
| $Fe_{50}Cr_{39}Zr_{11}$ | 694 | 946 |
| $Co_{82}Cr_{10}Zr_8$ | 505 | — |
| $Co_{80}Cr_{10}Zr_{10}$ | 509 | 606 |
| $Co_{70}Cr_{24}Zr_6$ | 544 | 772 |
| $Ni_{70}Cr_{20}Zr_{10}$ | 609 | 752 |
| $Fe_{45}Co_{36}Cu_9Zr_{10}$ | 483 | — |
| $Co_{80}Mo_{10}Zr_{10}$ | 581 | 762 |
| $Co_{82}Mo_{12}Zr_6$ | 527 | — |
| $Co_{84}Mo_8Zr_8$ | 506 | — |
| $Co_{88}W_2Zr_{10}$ | 525 | — |
| $Co_{82}W_8Zr_{10}$ | 571 | — |
| $Co_{80}W_{10}Zr_{10}$ | 584 | 734 |
| $Fe_{85}V_5Zr_{10}$ | 529 | 620 |
| $Fe_{80}V_{10}Zr_{10}$ | 557 | — |
| $Co_{60}V_{33}Zr_7$ | 595 | 657 |
| $Fe_{52.2}Co_{34.8}V_3Zr_{10}$ | 509 | — |
| $Fe_{48}Co_{32}V_{10}Zr_{10}$ | 537 | 599 |
| $Co_{85}Ti_5Zr_{10}$ | 502 | — |
| $Fe_{30}Ni_{40}Nb_{20}Zr_{10}$ | 598 | — |
| $Co_{80}Ta_{10}Zr_{10}$ | 587 | — |
| $Fe_{51}Co_{34}Mn_5Zr_{10}$ | 463 | — |
| $Fe_{48}Co_{32}Mn_{10}Zr_{10}$ | 436 | 606 |
| $Fe_{51}Co_{34}Cu_5Zr_{10}$ | 468 | 579 |
| $Fe_{80}Be_{10}Zr_{10}$ | 543 | 649 |
| $Fe_{86}B_5Zr_9$ | 537 | — |
| $Co_{90}B_5Zr_5$ | 452 | — |
| $Fe_{51.6}Co_{34.4}B_5Zr_9$ | 487 | — |
| $Co_{85}C_5Zr_{10}$ | 479 | — |
| $Fe_{51.6}Co_{34.4}Si_5Zr_9$ | 474 | 681 |
| $Fe_{80}Al_{10}Zr_{10}$ | 565 | 642 |
| $Fe_{51}Co_{34}Al_5Zr_{10}$ | 478 | — |
| $Fe_{48}Co_{32}Al_{10}Zr_{10}$ | 488 | 627 |
| $Fe_{52.8}Co_{35.2}(LaCe)_2Zr_{10}$ | 477 | 673 |

The magnetic properties of the alloys of the present invention are shown in the following Table 3.

TABLE 3

| Alloy | Rapidly quenched state | | After heat treatment | |
|---|---|---|---|---|
| | Magnetic induction $B_{10}$ (kg) | Coercive force Hc (Oe) | Magnetic induction B (kg) | Coercive force Hc (Oe) |
| $Co_{90}Zr_{10}$ | 9,300 | 0.1 | — | — |
| $Co_{91}Zr_9$ | 10,700 | 0.05 | — | — |
| $Fe_{54}Co_{36}Zr_{10}$ | 15,800 | 0.1 | — | — |
| $Co_{84}Cr_6Zr_{10}$ | 8,300 | 0.05 | — | — |
| $Co_{80}Cr_{10}Zr_{10}$ | 7,000 | 0.04 | — | — |
| $Fe_{45}Co_{36}Cr_9Zr_{10}$ | 10,000 | 0.09 | 10,000 | 0.03 |
| $Fe_{48}Co_{32}Al_{10}Zr_{10}$ | 9,500 | 0.07 | — | — |
| $Fe_{51.6}Co_{34.4}B_5Zr_{10}$ | 5,000 | 0.02 | 5,000 | 0.01 |

In the alloys in Table 3, except for the alloys containing B, the magnetic induction is as high as 7,000 to 15,800, and the coercive force is relatively low, and the alloys show the soft magnetic property.

The greatest characteristic of these alloys is that the magnetic properties are thermally very stable.

In order to confirm the thermal stability of the magnetic properties of the alloys of the present invention, the amorphous alloy having the composition of $Fe_{45}Co_{36}Cr_9Zr_{10}$ in Table 3 was heated at 465° C. for 10 minutes to remove the strain, and then heated at 100° C. for 1,000 minutes. The coercive force was 0.03 Oe and no variation was found. This shows that the alloy of the present invention is more magnetically stable than a prior metal-metalloid amorphous alloy, for example, $Fe_5Co_{70}Si_{15}B_{10}$. When the alloy $Fe_5Co_{70}Si_{15}B_{10}$ was heated at 100° C. for 1,000 minutes, the coercive force varied from 0.01 Oe to 0.06 Oe.

EXAMPLE 2

Ribbon-formed samples of the alloys of the present invention were immersed in aqueous solutions of 1N-$H_2SO_4$, 1N-HCl and 1N-NaCl at 30° C. for one week to carry out a corrosion test. The obtained results are shown in the following Table 4 together with the results of stainless steels.

TABLE 4

| Alloy | Corrosion rate (mg/cm²/year) 1N—$H_2SO_4$ 30° C. | 1N—HCl 30° C. | 1N—NaCl 30° C. |
|---|---|---|---|
| $Fe_{54}Co_{36}Zr_{10}$ | 1,658.8 | 8,480 | 10.1 |
| $Fe_{67}Cr_{22}Zr_{11}$ | 0.45 | 6.3 | 0.0 |
| $Fe_{50}Cr_{40}Zr_{10}$ | 0.0 | 0.0 | 0.0 |
| $Co_{80}Mo_{10}Zr_{10}$ | 27.2 | 36.5 | 0.0 |
| $Fe_{30}Co_{30}Cr_{20}Mo_{10}Zr_{10}$ | 0.0 | 0.0 | 0.0 |
| $Fe_{51}Co_{34}Cu_5Zr_{10}$ | 297.8 | 680.8 | 0.0 |
| 13% Cr steel | 515 | 600 | 451 |
| 304 Steel | 25.7 | 50.0 | 22 |
| 316 L steel | 8.6 | 10.0 | 10 |

This table shows that the amorphous alloys containing Cr or Mo have particularly excellent corrosion resistance, but in other alloys the corrosion rate is equal to or higher than that of stainless steels. That is, the amorphous alloys consisting of iron group elements and Zr, for example, $Fe_{54}Co_{36}Zr_{10}$ are inferior to 13% Cr steel in corrosion resistance against $H_2SO_4$ and HCl but possess 40 times higher corrosion resistance against NaCl than 13% Cr steel. Furthermore, when Cr and Mo are added, such alloys have more excellent properties than 304 steel and 316 L steel.

As mentioned above, the alloys of the present invention are completely novel amorphous alloys, the composition range of which has been generally considered not to form amorphous alloys, and which are completely different from the previously known metal-metalloid amorphous alloys and also metal-metal amorphous alloys.

Among them, the alloys wherein Fe and/or Co is rich are high in magnetic induction and relatively low in coercive force and are very excellent in thermal stability, so that these alloys also have the characteristics that the magnetic and mechanical properties are thermally stable.

By the addition of the third elements, such as Cr, Mo, etc., the crystallizing temperature is raised, the thermal stability is improved and the corrosion resistance can be noticeably improved.

INDUSTRIAL APPLICABILITY

The amorphous alloys of the present invention can greatly improve the thermal stability, which has not been satisfied in the well known metal-metalloid amorphous alloys, and still have the high strength and toughness which are the unique properties of amorphous alloys. Accordingly, these alloys can be used for various applications which effectively utilize these properties, for example, materials having a high strength, such as composite materials, spring materials, and a part of the alloys can be used for materials having a high magnetic permeability and materials having high corrosion resistance.

We claim:

1. Amorphous alloys containing iron group elements and zirconium and having the composition defined by the following formula $$X_{\alpha'}Y_{\beta'}Z_{\gamma'},$$

wherein $X_{\alpha'}$ shows that at least one element selected from the group consisting of Fe, Co and Ni is contained in an amount of $\alpha'$ atomic %, $Y_{\beta'}$ shows that at least one element selected from the group consisting of Cr, Mo, W, Ti, V, Nb, Ta, Mn, Cu, Be, Al, In, Sn, N, and lanthanum group elements is contained in an amount of $\beta'$ atomic %, $\beta'>0$, and $Z_{\gamma'}$ shows that Zr is contained in an amount of $\gamma'$ atomic %, the sum of $\beta'$, $\beta'$ and $\gamma'$ is 100 and each value of $\alpha'$, $\beta'$ and $\gamma'$ is as shown in the following (A), (B), (C), (D), (E) and (F):

(A) when Y is at least one element selected from the group consisting of Cr, Mo and W, $\alpha'$ is 40 to 92, $\beta'$ is not more than 40 and $\gamma'$ is 5 to 20, provided that the sum of $\beta'$ and $\gamma'$ is not less than 8, (B) when Y is at least one element selected from the group consisting of Ti, V, Nb, Ta, Cu and Mn, $\alpha'$ is 45 to 92, $\beta'$ is not more than 35, $\gamma'$ is 5 to 20, provided that the sum of $\beta'$ and $\gamma'$ is not less than 8, (C) when Y is at least one element selected from the group consisting of Be and Al, $\alpha'$ is 67 to 92, $\beta'$ is less than 13 and $\gamma'$ is 3 to 20, provided that the sum of $\beta'$ and $\gamma'$ is not less than 8, (D) when Y is at least one element selected from the group consisting of N, In and Sn, $\alpha'$ is 70 to 92, $\beta'$ is not more than 10 and $\gamma'$ is within the range of 5 to 20 wherein amorphous formation is possible, provided that the sum of $\beta'$ and $\gamma'$ is not less than 8, (E) when Y is at least one element selected from lanthanum group elements, $\alpha'$ is 70 to 92, $\beta'$ is not more than 10 and $\gamma'$ is 8 to 20 , provided that the sum of $\beta'$ and $\gamma'$ is not less than 8, and (F) when elements of at least two groups selected from the above described groups (A), (B), (C), (D) and (E) are combined, $\beta'$ is within the range of $\beta'$ value in each of the groups (A), (B), (C), (D) and (E) and the total value of $\beta'$ is not more than 40, $\alpha'$ is 40 to 92, $\gamma'$ is 5 to 20 and the sum of $\beta'$ and $\gamma'$ is not less than 8, provided that when at least one element is selected from each of the groups (C) and (D), the sum of these elements is less than 13 atomic %.

2. Articles consisting of powder and its moldings, wires or plates made of the alloys as claimed in claim 1.

3. Amorphous alloys according to claim 1, wherein when Y is Cr, $\beta'$ is not more than 20.

4. Articles consisting of powder and its moldings, wires or plates made of the alloys as claimed in claim 3.

5. A ferromagnetic amorphous alloy having a composition expressed by $Co_xNi_yFe_z)_aM_bG_c$ wherein M is at least one transition metal element selected from the group consisting of Cr, Mo and W, G is Zr and wherein x, y, z and a, b, c are selected to meet the conditions $0<x=1-y-z$, $0\leqq y<1$, $0\leqq z<1$, $a=1-b-c$, $0\leqq b\leqq 0.05$, $0.09\leqq c\leqq 0.01$, and $b+c\geqq 0.09$.

6. A ferromagnetic amorphous alloy as claimed in claim 5, wherein the element represented by M is Cr.

7. A ferromagnetic amorphous alloy having a composition expressed by $(Co_xNi_yFe_z)_aM_bG_c$ wherein M is at least one transition metal element selected from the group consisting of Ti, Cr, Mo and W, G is Zr, and wherein x, y, z and a, b and c are selected to meet the conditions $0 \leqq x = 1-y-z$, $0 \leqq y \leqq 1$, $0 \leqq z \leqq 1$, $a = 1-b-c$, $0 < b \leqq 0.05$, $0.05 \leqq c \leqq 0.2$, and $b+c \geqq 0.08$.

8. A ferromagnetic amorphous alloy as claimed in claim 7, wherein y, z and b meet the condition of $y+z+b>0$.

9. A ferromagnetic amorphous alloy as claimed in claim 7, wherein y meets the condition of $0<y \leqq 0.2$.

10. A ferromagnetic amorphous alloy as claimed in claim 7, wherein z meets the condition of $0<z \leqq 0.7$.

11. A ferromagnetic amorphous alloy as claimed in claim 7, wherein y and z meet the conditions of $0<y \leqq 0.2$, and $0<z \leqq 0.7$.

12. A ferromagnetic amorphous alloy as claimed in claim 7, wherein the element represented by M is Cr.

13. Amporphous alloys containing iron group elements and zirconium and having the composition defined by the following formula $$X_\alpha Z_\gamma$$

wherein $X_\alpha$ shows that at least two elements selected from the group consisting of Fe, Co and Ni are contained in an amount of $\alpha$ atomic %, $Z_\gamma$ shows that Zr is contained in an amount of $\gamma$ atomic %, the sum of $\alpha$ and $\gamma$ is 100 and $\alpha$ is 80 to 92 and $\gamma$ is 8 to 20.

14. Articles consisting of powder and its moldings, wires or plates made of the alloys as claimed in claim 13.

15. A ferromagnetic amorphous alloy having a composition expressed by $(Co_xNi_yFe_z)_aG_c$ wherein G is Zr, and wherein x, y, z, a and c are selected to meet the conditions $0<x=1-y-z$, $0 \leqq y<1$, $0 \leqq z<1$, $y+z>0$, $a=1-c$, and $0.09 \leqq c \leqq 0.1$.

16. A ferromagnetic amorphous alloy as claimed in claim 15, wherein z and c meet the conditions of $z \simeq 0$ and $c \simeq 0.1$.

17. Articles consisting of powder and its moldings, wires or plates made of the alloys as claimed in claim 15.

18. A ferromagnetic amorphous alloy having a composition expressed by $(Co_xNi_yFe_z)_aG_c$ wherein G is Zr, and wherein x, y, z, a and c are selected to meet the conditions $0 \leqq x=1-y-z$, $0<y \leqq 0.2$, $0 \leqq z<1$, $a=1-c$, and $0.08 \leqq c \leqq 0.11$.

19. A ferromagnetic amorphous alloy having a composition expressed by $(Co_xNi_yFe_z)_aG_c$ wherein G is Zr, and wherein x, y, z, a and c are selected to meet the conditions $0 \leqq x=1-y-z$, $0 \leqq y<1$, $0<z \leqq 0.7$, $a=1-c$, and $0.08 \leqq c \leqq 0.11$.

* * * * *